US010731478B2

(12) United States Patent
Xu et al.

(10) Patent No.: US 10,731,478 B2
(45) Date of Patent: Aug. 4, 2020

(54) TURBINE BLADE WITH A COUPLED SERPENTINE CHANNEL

(71) Applicant: Solar Turbines Incorporated, San Diego, CA (US)

(72) Inventors: Hongzhou Xu, San Diego, CA (US); Kevin Liu, San Diego, CA (US); Michael D. Fox, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 16/217,953

(22) Filed: Dec. 12, 2018

(65) Prior Publication Data

US 2020/0190998 A1 Jun. 18, 2020

(51) Int. Cl.
*F01D 5/18* (2006.01)
*F01D 5/30* (2006.01)
*F01D 5/14* (2006.01)

(52) U.S. Cl.
CPC ..... *F01D 5/188* (2013.01); *F01D 5/141* (2013.01); *F01D 5/187* (2013.01); *F01D 5/3015* (2013.01); *F05D 2220/32* (2013.01); *F05D 2260/205* (2013.01); *F05D 2260/22141* (2013.01); *F05D 2260/232* (2013.01)

(58) Field of Classification Search
CPC ..... F01D 5/141; F01D 5/187; F01D 5/188; F01D 5/3015; F05D 2220/32; F05D 2260/205; F05D 2260/22141; F05D 2260/232
See application file for complete search history.

(56) References Cited

U.S. PATENT DOCUMENTS 4,474,532 A * 10/1984 Pazder ..... F01D 5/187 415/115
5,403,159 A * 4/1995 Green ..... F01D 5/187 416/97 R
5,591,007 A * 1/1997 Lee ..... F01D 5/187 416/97 R
6,220,817 B1 * 4/2001 Durgin ..... F01D 5/187 415/115
6,290,463 B1 * 9/2001 Fargher ..... F01D 5/187 415/115
7,682,133 B1 * 3/2010 Liang ..... F01D 5/187 416/97 R
7,988,419 B1 8/2011 Liang
8,118,553 B2 2/2012 Liang
(Continued)

*Primary Examiner* — Igor Kershteyn
(74) *Attorney, Agent, or Firm* — Procopio, Cory, Hargreaves & Savitch LLP

(57) ABSTRACT

A turbine blade having a base and an airfoil, the base including a root end. The airfoil including a skin extending from the base and defining a first edge, a second edge, having a tip end opposite from the root end. The turbine blade further including a base rib extending from the base and into the airfoil, a center divider extending from adjacent the first edge towards the second edge, a center rib disposed between the center divider and the second edge, extending from adjacent the center divider towards the tip end and extending from adjacent the center divider towards the root end, a tip center rib extending from adjacent the second edge towards the first edge, a tip rib extending from adjacent the tip center rib towards the base, a dividing rib and a first channel.

20 Claims, 6 Drawing Sheets

(56) References Cited

U.S. PATENT DOCUMENTS

| | | | | |
|---|---|---|---|---|
| 8,317,472 | B1 * | 11/2012 | Liang | F01D 5/187 416/92 |
| 8,628,298 | B1 * | 1/2014 | Liang | F01D 5/187 416/96 R |
| 2017/0292386 | A1 * | 10/2017 | Zhang | F01D 5/187 |

* cited by examiner

TURBINE BLADE WITH A COUPLED SERPENTINE CHANNEL

TECHNICAL FIELD

The present disclosure generally pertains to gas turbine engines. More particularly this application is directed toward a turbine blade with a coupled serpentine channel.

BACKGROUND

Internally cooled turbine blades may include passages within the blade. These hollow blades may be cast. In casting hollow gas turbine engine blades having internal cooling passageways, a fired ceramic core is positioned in a ceramic investment shell mold to form internal cooling passageways in the cast airfoil. The fired ceramic core used in investment casting of hollow airfoils typically has an airfoil-shaped region with a thin cross-section leading edge region and trailing edge region. Between the leading and trailing edge regions, the core may include elongated and other shaped openings so as to form multiple internal walls, pedestals, turbulators, ribs, and similar features separating and/or residing in cooling passageways in the cast airfoil.

U.S. Pat. No. 8,118,553 to George Liang, describes a cooling system for a turbine airfoil of a turbine engine having dual serpentine cooling channels, an inward serpentine cooling channel and an outward serpentine cooling channel, positioned within the airfoil. The inward serpentine cooling channel may receive cooling fluids from a cooling supply system through the root and exhaust cooling fluids to the outward serpentine cooling channel at the leading edge. The outward serpentine cooling channel may pass the cooling fluids through the outward portion of the serpentine cooling channel and exhaust the cooling fluids through the trailing edge of the airfoil. Such configuration yields a better creep capability for the blade.

The present disclosure is directed toward overcoming one or more of the problems discovered by the inventors.

SUMMARY

A turbine blade for a gas turbine engine is disclosed herein. In embodiments the turbine blade includes a base and an airfoil. The base includes a root end and the airfoil includes a skin extending from the base and defining a first edge, a second edge opposite the first edge, a pressure side, and a lift side opposite the pressure side, and having a tip end opposite from the root end.

The airfoil further includes a base rib, a center divider, a center rib, a tip center rib, a tip rib, a tip wall, and a dividing rib. The base rib disposed within the airfoil and the base, extending from the base and into the airfoil, and having a base rib end disposed opposite from the base. The center divider extending from adjacent the first edge towards the second edge, disposed between the base rib and the tip end. The center rib disposed between the center divider and the second edge, extending from adjacent the center divider towards the tip end and extending from adjacent the center divider towards the root end, the center rib disposed between the root end and the tip end and at least partially between the base rib and the second edge. The center rib having a center rib tip end disposed at the tip end of the center rib, and a center rib base end disposed opposite from the tip end. The tip center rib extending from adjacent the second edge towards the first edge, disposed between the center rib and the tip end. The tip rib extending from adjacent the tip center rib, distal to the second edge, towards the base, the tip rib disposed at least partially between the center rib and the first edge, disposed between the center divider and the tip end, and having a tip rib end disposed opposite from the tip end. The dividing rib extending from a dividing rib base end proximate an interface of the airfoil and the base, towards the tip end while between the first edge and the base rib, to between the tip rib and the first edge and between the tip end and the center divider. The dividing rib having a dividing rib tip end disposed proximate and spaced from the tip end.

The turbine blade further includes a first channel beginning between the dividing rib base end and the first edge. The first channel extending to the center divider while between the first edge and the dividing rib. The first channel further extends around the base rib tip, between the dividing rib and the center divider, and further to between the dividing rib and the center rib. The first channel further extends toward the root end while located between the dividing rib and the center rib. The first channel further extends around the center rib base end while between the center rib and the dividing rib, towards the tip end while between the center rib and the dividing rib. The first channel further extends towards the tip end while between the center rib and the dividing rib. The first channel further extends around the center rib tip end while between the center rib and dividing rib, towards the base while between the dividing rib and the center rib. The first channel further extends to the center divider while between the dividing rib and center rib. The first channel further extends around the tip rib end while between the dividing rib and the center divider, to between the dividing rib and the first edge. The first channel further extends towards the tip end, between the first edge and the dividing rib, to between the dividing rib and the tip wall.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that the disclosure without these specific details. In some instances, well-known structures and components are shown in simplified form for brevity of description.

Figure 1:
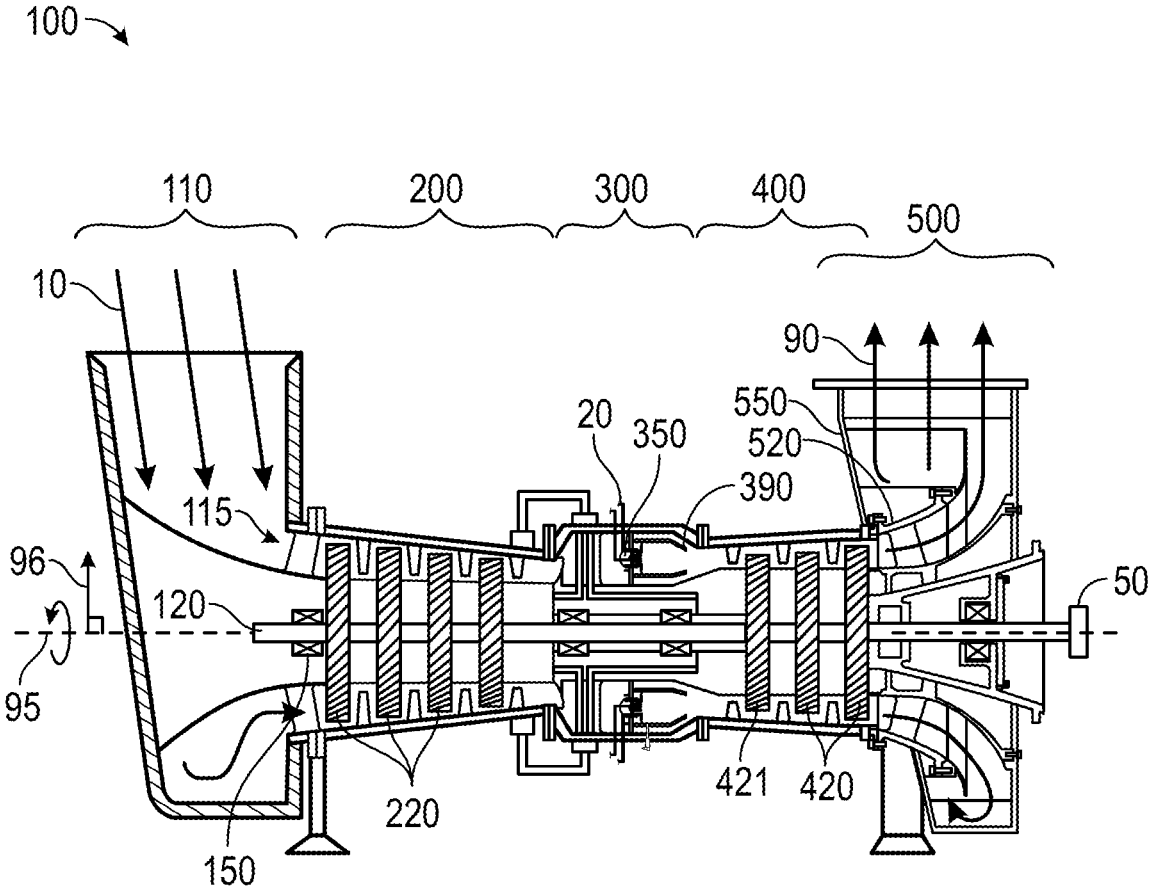
FIG. 1 is a schematic illustration of an exemplary gas turbine engine.

FIG. 1 is a schematic illustration of an exemplary gas turbine engine. Some of the surfaces have been left out or exaggerated for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a gas producer or "compressor" 200, a combustor 300, a turbine 400, an exhaust 500, and a power output coupling 50. The compressor 200 includes one or more compressor rotor assemblies 220. The combustor 300 includes one or more injectors 350 and includes one or more combustion chambers 390. The turbine 400 includes one or more turbine rotor assemblies 420. The exhaust 500 includes an exhaust diffuser 520 and an exhaust collector 550.

As illustrated, both compressor rotor assembly 220 and turbine rotor assembly 420 are axial flow rotor assemblies, where each rotor assembly includes a rotor disk that is circumferentially populated with a plurality of airfoils ("rotor blades"). When installed, the rotor blades associated with one rotor disk are axially separated from the rotor blades associated with an adjacent disk by stationary vanes ("stator vanes" or "stators") circumferentially distributed in an annular casing.

A gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly 421 is the forward most of the turbine rotor assemblies 420. However, other numbering/naming conventions may also be used.

Once compressed air 10 leaves the compressor 200, it enters the combustor 300, where it is diffused and fuel 20 is added. Air 10 and fuel 20 are injected into the combustion chamber 390 via injector 350 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 520 and collected, redirected, and exit the system via an exhaust collector 550. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
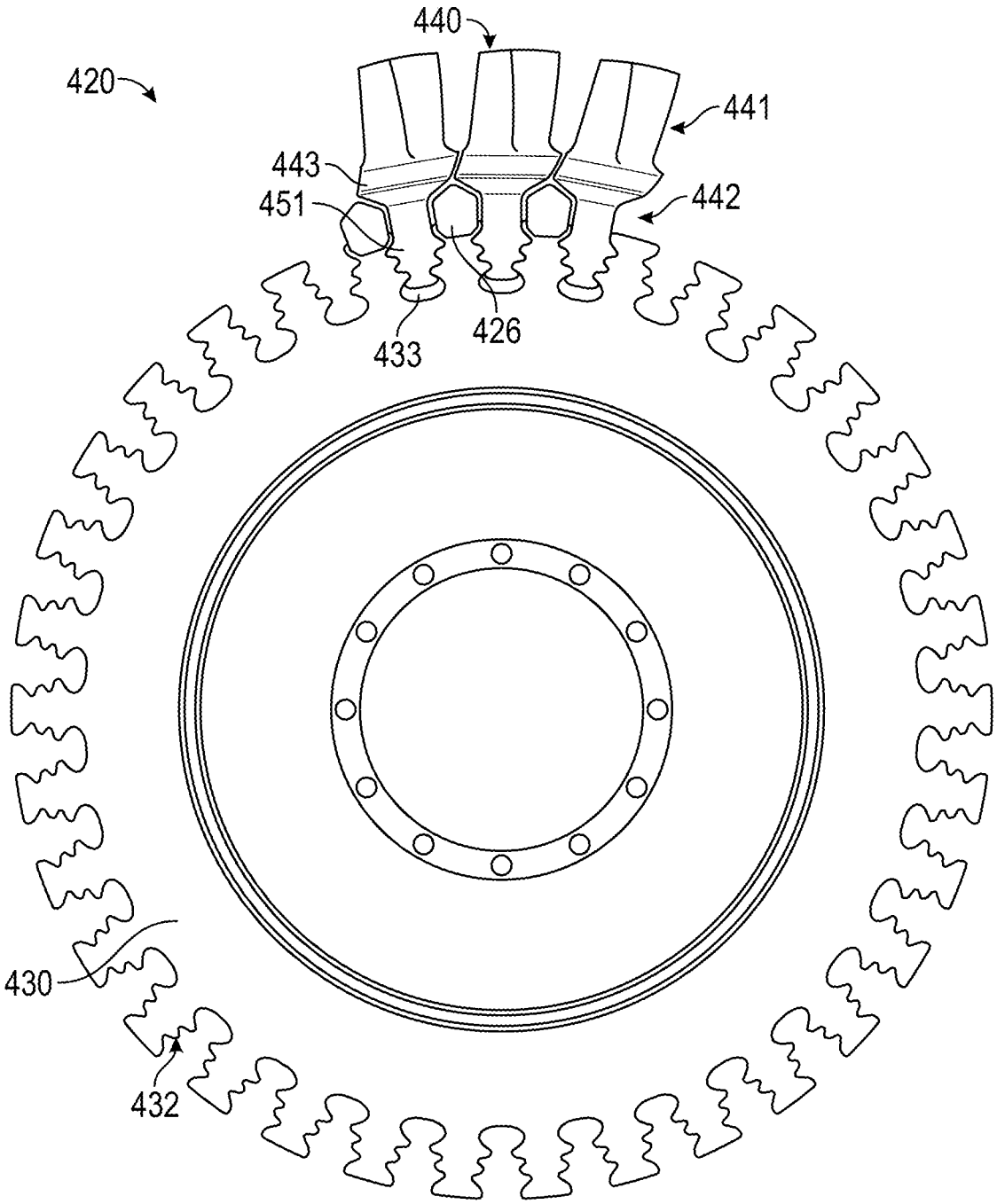
FIG. 2 is an axial view of an exemplary turbine rotor assembly.

FIG. 2 is an axial view of an exemplary turbine rotor assembly. In particular, the turbine rotor assembly 420 schematically illustrated in FIG. 1 is shown here in greater detail, but in isolation from the rest of gas turbine engine 100. The turbine rotor assembly 420 includes a turbine rotor disk 430 that is circumferentially populated with a plurality of turbine blades configured to receive cooling air ("cooled turbine blades" 440) and a plurality of dampers 426. Here, for illustration purposes, turbine rotor disk 430 is shown depopulated of all but three cooled turbine blades 440 and three dampers 426.

Each cooled turbine blade 440 may include a base 442 including a platform 443 and a blade root 451. For example, the blade root 451 may incorporate "fir tree", "bulb", or "dove tail" roots, to list a few. Correspondingly, the turbine rotor disk 430 may include a plurality of circumferentially distributed slots or "blade attachment grooves" 432 configured to receive and retain each cooled turbine blade 440. In particular, the blade attachment grooves 432 may be configured to mate with the blade root 451, both having a reciprocal shape with each other. In addition the blade attachment grooves 432 may be slideably engaged with the blade attachment grooves 432, for example, in a forward-to-aft direction.

Being proximate the combustor 300 (FIG. 1), the turbine rotor assembly 420 may incorporate active cooling. In particular, compressed cooling air may be internally supplied to each cooled turbine blade 440 as well as predetermined portions of the turbine rotor disk 430. For example, here turbine rotor disk 430 engages the cooled turbine blade 440 such that a cooling air cavity 433 is formed between the blade attachment grooves 432 and the blade root 451. In other embodiments, other stages of the turbine may incorporate active cooling as well.

When a pair of cooled turbine blades 440 is mounted in adjacent blade attachment grooves 432 of turbine rotor disk 430, an under-platform cavity may be formed above the circumferential outer edge of turbine rotor disk 430, between shanks of adjacent blade roots 451, and below their adjacent platforms 443, respectively. As such, each damper 426 may be configured to fit this under-platform cavity. Alternately, where the platforms are flush with circumferential outer edge of turbine rotor disk 430, and/or the under-platform cavity is sufficiently small, the damper 426 may be omitted entirely.

Here, as illustrated, each damper 426 may be configured to constrain received cooling air such that a positive pressure may be created within the under-platform cavity to suppress the ingress of hot gases from the turbine. Additionally, damper 426 may be further configured to regulate the flow of cooling air to components downstream of the turbine rotor assembly 420. For example, damper 426 may include one or more aft plate apertures in its aft face. Certain features of the illustration may be simplified and/or differ from a production part for clarity.

Each damper 426 may be configured to be assembled with the turbine rotor disk 430 during assembly of the turbine rotor assembly 420, for example, by a press fit. In addition, the damper 426 may form at least a partial seal with the adjacent cooled turbine blades 440. Furthermore, one or more axial faces of damper 426 may be sized to provide sufficient clearance to permit each cooled turbine blade 440 to slide into the blade attachment grooves 432, past the damper 426 without interference after installation of the damper 426.

Figure 3:
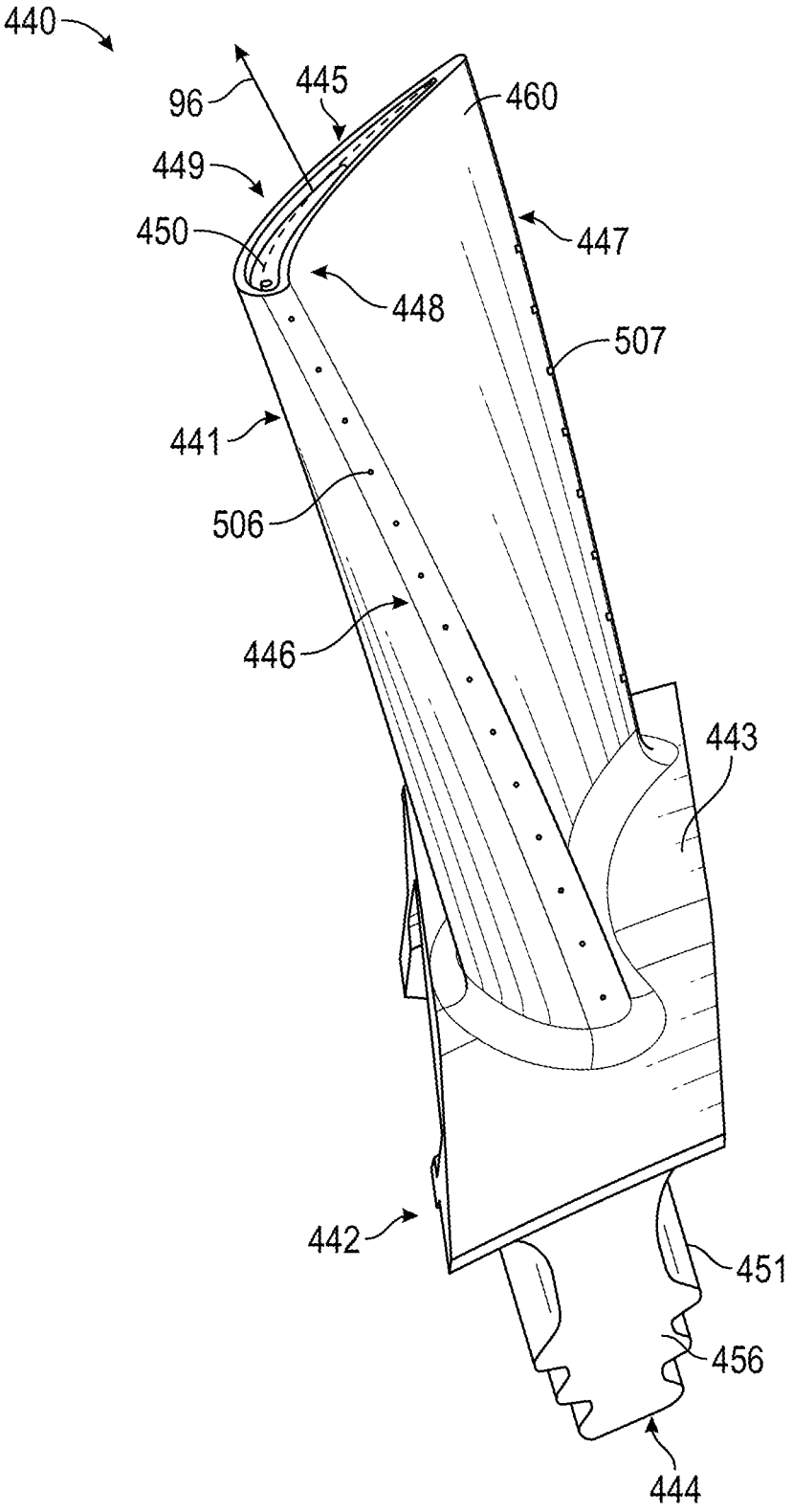
FIG. 3 is an isometric view of one turbine blade of FIG. 2.

FIG. 3 is a perspective view of the turbine blade of FIG. 2. As described above, the cooled turbine blade 440 may include a base 442 having a platform 443, a blade root 451, and a root end 444. Each cooled turbine blade 440 may further include an airfoil 441 extending radially outward from the platform 443. The airfoil 441 may have a complex, geometry that varies radially. For example the cross section of the airfoil 441 may lengthen, thicken, twist, and/or change shape as it radially approaches the platform 443 inward from a tip end 445. The overall shape of airfoil 441 may also vary from application to application.

The cooled turbine blade 440 is generally described herein with reference to its installation and operation. In particular, the cooled turbine blade 440 is described with reference to both a radial 96 of center axis 95 (FIG. 1) and the aerodynamic features of the airfoil 441. The aerodynamic features of the airfoil 441 include a leading edge 446, a trailing edge 447, a pressure side 448, a lift side 449, and its mean camber line 450. The leading edge 446 and the trailing edge 447, either one of which can be referred to a first edge or a second edge. The leading edge 446 may have leading edge holes 506 and trailing edge 447 may have trailing edge slots 507 that can permit cooling air 15 to exit the turbine blade 440. The mean camber line 450 is generally defined as the line running along the center of the airfoil from the leading edge 446 to the trailing edge 447. It can be thought of as the average of the pressure side 448 and lift side 449 of the airfoil 441 shape. As discussed above, airfoil 441 also extends radially between the platform 443 and the tip end 445. Accordingly, the mean camber line 450 herein includes the entire camber sheet continuing from the platform 443 to the tip end 445.

Thus, when describing the cooled turbine blade 440 as a unit, the inward direction is generally radially inward toward the center axis 95 (FIG. 1), with its associated end called a "root end" 444. Likewise the outward direction is generally radially outward from the center axis 95 (FIG. 1), with its associated end called the "tip end" 445. When describing the platform 443, the forward face 456 and the aft face 457 of the platform 443 is associated to the forward and aft axial directions of the center axis 95 (FIG. 1), as described above. The base 442 can further include a forward face 456 and an aft face 457. The forward face 456 corresponds to the face of the base 442 that is disposed on the forward end of the base 442. The aft face 457 corresponds to the face of the base 442 that is disposed distal from the forward face 456.

In addition, when describing the airfoil 441, the forward and aft directions are generally measured between its leading edge 446 (forward) and its trailing edge 447 (*aft*), along the mean camber line 450 (artificially treating the mean camber line 450 as linear). When describing the flow features of the airfoil 441, the inward and outward directions are generally measured in the radial direction relative to the center axis 95 (FIG. 1). However, when describing the thermodynamic features of the airfoil 441 the inward and outward directions are generally measured in a plane perpendicular to a radial 96 of center axis 95 (FIG. 1) with inward being toward the mean camber line 450 and outward being toward the "skin" 460 of the airfoil 441.

Finally, certain traditional aerodynamics terms may be used from time to time herein for clarity, but without being limiting. For example, while it will be discussed that the airfoil 441 (along with the entire cooled turbine blade 440) may be made as a single metal casting, the outer surface of the airfoil 441 (along with its thickness) is descriptively called herein the "skin" 460 of the airfoil 441. In another example, each of the ribs described herein can act as a wall or a divider.

Figure 4:
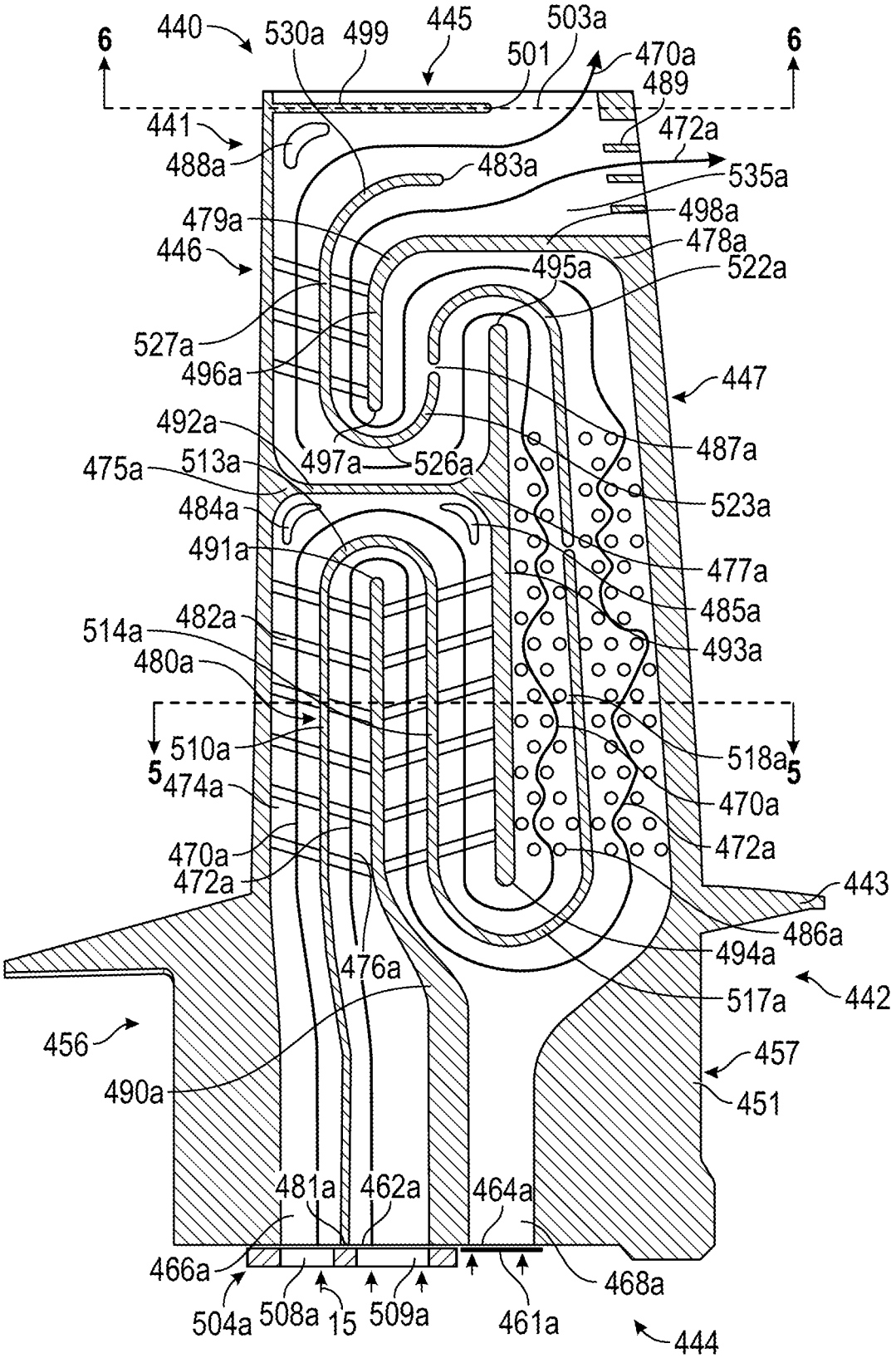
FIG. 4 is a cutaway side view of the turbine blade of FIG. 3.

FIG. 4 is a cutaway side view of the turbine blade of FIG. 3. In particular, the cooled turbine blade 440 of FIG. 3 is shown here with the skin 460 removed from the pressure side 448 of the airfoil 441, exposing its internal structure and cooling paths. The airfoil 441 may include a composite flow path made up of multiple subdivisions and cooling structures. Similarly, a section of the base 442 has been removed to expose portions of a main inlet passage 466*a* and a secondary inlet passage 468*a* internal to the base 442. The turbine blade 440 shown in FIG. 4 generally depicts the features visible from the pressure side 448. The leading edge holes 506 and the trailing edge slots 507 have not been shown in FIG. 4.

The cooled turbine blade 440 includes an airfoil 441 and a base 442. The base 442 may include the platform 443, the blade root 451, the forward face 456, the aft face 457, the root end 444, a main inlet 462*a*, and a secondary inlet 464*a*. The airfoil 441 interfaces with the base 442 and may include the skin 460, a tip wall 499, a dividing rib 480*a*, a tip opening 503*a*, and a trailing edge outlet 489*a*.

Compressed secondary air 15 may be routed into the main inlet 462*a* and secondary inlet 464*a* in the base 442 of cooled turbine blade 440 as cooling air 15. The main inlet 462*a* and secondary inlet 464*a* may be at any convenient location. For example, here, the main inlet 462*a* and secondary inlet 464*a* are located in the blade root 451. Alternately, cooling air 15 may be received in a shank area radially outward from the blade root 451 but radially inward from the platform 443. The main inlet 462*a* may be disposed between the forward face 456 and the secondary inlet 464*a*. The main inlet 462*a* is configured to allow compressed cooling air 15 into the turbine blade 440. The secondary inlet may be disposed between the main inlet 462*a* and the aft face 457. In an embodiment, a blocking plate 461*a* may be disposed radially inward of the secondary inlet 464*a* and can restrict the cooling air 15 from entering the secondary inlet 464*a*. In some embodiments the secondary inlet 464*a* is present to aid in casting the cooled turbine blade 440.

Within the base 442, the cooled turbine blade 440 includes the main inlet passage 466*a* configured to route cooling air 15 from the main inlet 462*a*, through the base 442, and into the airfoil 441 via the first channel 474*a* and the second channel 476*a*. The base 442 may also include a secondary inlet passage 468*a* that is configured to route cooling air 15 from the secondary inlet 464*a*, through the base 442 and into the airfoil 441 via the second channel 476*a*. The main inlet passage 466*a* and secondary inlet passage 468*a* may be configured to translate the cooling air 15 in three dimensions (e.g., not merely in the plane of the figure) as it travels radially up (e.g., generally along a radial 96 of the center axis 95 (FIG. 1)) towards the airfoil 441 and along a first multi-bend heat exchange path 470*a* and a second multi-bend heat exchange path 472*a*. For example, the cooling air 15 can travel radially and within the airfoil 441. The first multi-bend heat exchange path 470*a* and the second multi-bend heat exchange path 472*a* are depicted as solid lines drawn as a weaving path through the airfoil 441, exiting through the airfoil 441 and ending with an arrow. The first multi-bend heat exchange path 470*a* may be an air flow path confined or substantially confined by the first channel 474*a* and the second multi-bend heat exchange path 472*a* may be an air flow path confined or substantially confined by the second channel 476*a*.

Within the skin 460 of the airfoil 441 and the base 442 of the turbine blade, several internal structures are viewable. In particular, the turbine blade 440 includes a base rib 490*a*, a center divider 492*a*, a center rib 493*a*, a tip rib 496*a*, a tip center rib 498*a*, and a dividing rib 480*a*. Several of the internal structures, such as the base rib 490*a*, the center divider 492*a*, the center rib 493*a*, the tip rib 496*a*, the tip center rib 498*a*, and the dividing rib 480*a*, may remain continuous or include gaps. In addition, the airfoil 441 may include a tip wall 499, turbulators 482*a*, a first edge air deflector 484*a*, a center air deflector 485*a*, a tip air deflector 488*a*, cooling fins 486*a*, a trailing edge outlet 489*a*, and a tip opening 503*a*.

In an embodiment, the base rib 490*a* is disposed within the airfoil 441 and the base 442 and extends from the base 442 and up into the airfoil 441. In other words, the base rib 490*a* can be disposed between the main inlet passage 466*a* and the secondary inlet passage 468*a* and extend from the root end 444 towards the tip end 445. The base rib 490*a* can bend towards the leading edge 446 when located proximate to the interface of the airfoil 441 and the base 442. The base rib 490*a* can extend from the pressure side 448 of the skin 460 to the lift side 449 of the skin 460. The base rib 490*a* may be located between the main inlet 462*a* and the secondary inlet 464*a*. The base rib 490*a* can be wider adjacent the root end 444 than opposite from the root end 444. The base rib 490*a* may include a base rib end 491*a* disposed opposite from the base 442. The base rib end 491*a* may be disposed closer to the leading edge 446 than the base rib 490*a* proximate the root end 444.

In an embodiment, the center divider 492*a* extends from leading edge 446 towards the trailing edge 447. The center divider 492*a* is disposed between the base rib 490*a* and the tip end 445. Further, the center divider 492*a* can be disposed between the base rib 490*a* and the tip rib 496*a*. The center divider 492*a* can extend from the pressure side 448 of the skin 460 to the lift side 449 of the skin 460. The center divider 492*a* can have a center divider transition 475*a* that extends from the center divider 492*a* to the leading edge 446 and is wider adjacent the leading edge 446 than opposite the leading edge 446. The center divider transition 475*a* may be shaped as a double fillet tee joint joining the center divider 492*a* to the leading edge 446. The center divider 492*a* may have a center rib transition 477*a* that is disposed opposite from the center divider transition 475*a*. The center rib transition 477*a* may extend from the center divider 492*a* to the center rib 493*a* and be wider adjacent the center rib 493*a* than opposite the center rib 493*a*. The center rib transition 477*a* may be shaped as a double fillet tee joint joining the center divider 492*a* to the center rib 493*a*.

The center rib 493*a* is disposed between the center divider 492*a* and the trailing edge 447. The center rib 493*a* extends from adjacent the center divider 492*a* towards the tip end 445 and extends from adjacent the center divider 492*a* towards the root end 444. The center rib 493*a* is also disposed between the root end 444 and the tip end 445. In an embodiment, the center rib 493*a* may be disposed between the base 442 and the tip center rib 498*a* and can adjoin the center rib transition 477*a*. The center rib can extend 493*a* from the center divider 492*a* to proximate to the interface of where the airfoil 441 extends from the base 442. The center rib 493*a* can extend from the pressure side 448 of the skin 460 to the lift side 449 of the skin 460. The center rib 493*a* may a have a cross-section shaped as an elongated stadium. The center rib 493*a* may include a center rib tip end 495*a* disposed at the tip end 445 of the center rib 493*a* and a center rib base end 494*a* disposed opposite from the tip end 445.

The tip center rib 498*a* extends from the trailing edge 447 towards the leading edge 446 and is disposed between the center rib 493*a* and the tip end 445. The tip center rib 498*a* may extend from the pressure side 448 of the skin 460 to the lift side 449 of the skin 460. The tip center rib 498*a* can include a tip center rib transition 478*a* that extends from the tip center rib 498*a* to the trailing edge 447 and be wider adjacent to the trailing edge 447 than opposite the trailing edge 447. The tip center rib transition 478*a* may be shaped as a fillet joining the tip center rib 498*a* to the trailing edge 447. The tip center rib 498*a* may include a tip rib transition 479*a* that is disposed opposite from the tip center rib transition 478*a* that extends from the tip center rib 498*a* towards the base 442. The tip rib transition 479*a* may be shaped as a fixed radial transition joining the tip center rib 498*a* to the tip rib 496*a*.

The tip rib 496*a* extends from the tip center rib 498*a* towards the base 442 and is disposed between the center rib 493*a* and the leading edge 446. The tip rib 496*a* is also disposed between the center divider 492*a* and the tip end 445. The tip rib 496*a* may extend from the tip rib transition 479*a* towards the base 442. The tip rib 496*a* may extend from the pressure side 448 of the skin to the lift side 449 of the skin 460. The tip rib 496*a* may in include a tip rib end 497*a* disposed opposite from the tip end 445.

The tip wall 499 may extend from the leading edge 446 towards the trailing edge 447 and disposed proximate the tip end 445. The tip wall 499 may extend from the pressure side 448 of the skin 460 to the lift side 449 of the skin 460. The tip wall 499 may be disposed between the tip end 445 and the tip center rib 498*a*. In other words the tip wall 499 may be disposed between the tip end 445 and the tip rib 496*a*. The tip wall 499 may be recessed inward such that it is not flush with the tip of the airfoil 441. The tip wall 499 may include a tip wall end 501 disposed opposite from the leading edge 446.

The tip opening 503*a* is defined by the space between the pressure side 448 of the skin 460, the lift side 449 of the skin, the tip wall 499, and the trailing edge 447. The tip opening 503*a* allows for cooling air 15 to escape the airfoil 441 through the tip end 445.

The trailing edge outlet 489*a* extends through the trailing edge 447 and is disposed proximate the tip end 445. The trailing edge outlet 489*a* allows for cooling air 15 to escape the airfoil 441 through the trailing edge 447.

The dividing rib 480*a* extends throughout the turbine blade 440 in a serpentine configuration. The dividing rib 480*a* can extend from adjacent the main inlet 462*a* to between the leading edge 446 and the base rib 490*a*. In an alternative embodiment the dividing rib 480*a* can extend from proximate to the interface of the airfoil 441 and the base 442, to between the leading edge 446 and the base rib 490*a*, and further to between the leading edge 446 and tip rib 496*a*. In other words the dividing rib can extend from proximate the base 442. The dividing rib 480*a* may have several portions including a dividing rib lower first edge portion 510*a*, a dividing rib lower first edge transition portion 513*a*, a dividing rib lower middle portion 514*a*, a dividing rib lower middle transition portion 517*a*, a dividing rib second edge portion 518*a*, a dividing rib second edge transition portion 522*a*, a dividing rib upper middle portion 523*a*, a dividing rib upper middle transition portion 526*a*, a dividing rib upper first edge portion 527*a*, and a dividing rib upper first edge transition portion 530*a*. The dividing rib 480*a* may extend from the pressure side 448 of the skin 460 to the lift side 449 of the skin 460. In an embodiment, the dividing rib 480*a* may have dividing rib gaps 487*a* disposed along the dividing rib 480*a*. Alternatively, the dividing rib 480*a* may remain continuous. The dividing rib 480*a* may also include a dividing rib tip end 483*a* disposed proximate and spaced from the tip end 445.

The dividing rib 480*a* may include a dividing rib base end 481*a* disposed opposite from the dividing rib tip end 483*a*. The dividing rib base end 481*a* can be disposed proximate and spaced from the leading edge 446, proximate to where the base 442 and airfoil 441 meet. The dividing rib 480*a* can be configured to divide the cooling air 15 into a first channel 474*a* and a second channel 476*a*. The airfoil 441 may include a tip end channel 535 that may begin proximate to the dividing rib tip end 483*a* and where the first channel 474*a* and the second channel 476*a* combine. The tip end channel 535 may be defined by the dividing rib tip end 483*a*, the tip center rib 498*a*, trailing edge 447, tip wall 499, the pressure side 448 of the skin 460, and the lift side 449 of the skin 460.

In an embodiment, the dividing rib lower first edge portion 510*a* can extend from adjacent the main inlet 462*a* and root end towards the tip end 445 while between the leading edge 446 and the base rib 490*a*. In an alternative embodiment, the dividing rib lower first edge portion 510*a* can extend from proximate to the interface of the airfoil 441 and the base 442 towards the tip end 445 while between the leading edge 446 and the base rib 490*a*. In other words, the dividing rib lower first edge portion 510*a* can extend from proximate the base 442 towards the center divider 492*a*. In other words, the dividing rib lower middle portion 514*a* can extend from proximate to the interface of the airfoil 441 and the base 442 to proximate the base rib end 491*a*.

The dividing rib lower first edge transition portion 513*a* can extend from the dividing rib lower first edge portion 510*a*, from between the leading edge 446 and the base rib 490*a*, around the base rib end 491*a*, to between the base rib 490*a* and the center divider 492*a*, and further to between the base rib 490*a* and the center rib 493*a*. The dividing rib lower first edge transition portion 513*a* may have a cross-section shaped as an annulus sector.

The dividing rib lower middle portion 514*a* can extend from the dividing rib lower first edge transition portion 513*a* towards the root end 444 while located between the base rib 490*a* and the center rib 493*a*. In other words, the dividing rib lower middle portion 514*a* can extend from proximate the base rib end 491*a* to proximate the center rib base end 494*a*. The dividing rib lower middle portion is disposed between the center divider 492*a* and the root end 444.

The dividing rib lower middle transition portion 517*a* can extend from the dividing rib lower middle portion 514*a*, from between the base rib 490*a* and the center rib 493*a*, around the center rib 493*a* base end 494*a*, to between the center rib 493*a* and the base rib 490*a*, and further to between the center rib 493*a* and the trailing edge 447. The dividing rib lower middle transition portion 517*a* may have a cross-section shaped as an annulus sector.

The dividing rib second edge portion 518*a* can extend from the dividing rib lower middle transition portion 517*a* towards the tip end 445 while between the center rib 493*a* and the trailing edge 447. In other words, the dividing rib second edge portion 518*a* can extend from proximate the center rib base end 494*a* to proximate the center rib tip end 495*a*. The dividing rib second edge portion 518*a* is disposed between the root end 444 and the tip center rib 498*a*.

The dividing rib second edge transition portion 522*a* can extend from the dividing rib second edge portion 518*a*, from between the trailing edge 447 and the center rib 493*a*, around the center rib tip end 495*a*, to between the center rib 493*a* and the tip center rib 498*a*, and further to between the tip rib 496*a* and the center rib 493*a*. The dividing rib second edge transition portion 522*a* may have a cross-section shaped as an annulus sector.

The dividing rib upper middle portion 523*a* can extend from the dividing rib second edge transition portion 522*a* towards the center divider 492*a* while between the tip rib 496*a* and center rib 493*a*. In other words, the dividing rib upper middle portion 523*a* can extend from proximate the center rib tip end 495*a* to proximate the tip rib end 497*a*. The dividing rib upper middle portion 523*a* is disposed between the tip end 445 and the center divider 492*a*.

The dividing rib upper middle transition portion 526*a* can extend from the dividing rib upper middle portion 523*a*, from between the tip rib 496*a* and the center rib 493*a*, around the tip rib end 497*a*, to between the tip rib 496*a* and the center divider 492*a*, and further to between the tip rib 496*a* and the leading edge 446. The dividing rib upper middle transition portion 526*a* may have a cross-section shaped as an annulus sector.

The dividing rib upper first edge portion 527*a* can extend from the dividing rib upper middle transition portion 526*a* towards the tip end 445, between the leading edge 446 and the tip rib 496*a*. In other words, the dividing rib upper first edge portion 527*a* can extend from proximate the tip rib end 497*a* towards the tip wall 499. The dividing rib upper first edge portion 527*a* is disposed between the center divider 492*a* and tip wall 499.

The dividing rib upper first edge transition portion 530*a* can extend from the dividing rib upper first edge portion 527*a* towards the tip end 445, from between the leading edge 446 and tip rib 496*a*, around the tip rib transition 479*a*, to between the tip end 445 and the tip center rib 498*a*. Together with the skin 460, the dividing rib 480*a* and other described structures, may form the first channel 474*a* and first multi-bend heat exchange path 470*a* along with the second channel 476 the second multi-bend heat exchange path 472*a* within the airfoil 441.

The first channel 474*a* may extend throughout the turbine blade 440 in a serpentine configuration similar to and partially defined by the dividing rib 480*a* and can be formed by the dividing rib 480*a*, the skin 460, and other internal structures in the airfoil 441. The first channel 474*a* can be in flow communication with the main inlet passage 466*a* and main inlet 462*a*. The first channel 474*a* can begin between the forward face 456 and the dividing rib 480*a* and disposed adjacent the main inlet 462*a*. Alternatively, the first channel 474*a* can begin between the dividing rib base end 481*a* and the leading edge 446. The first channel 474*a* can extend to the center divider 492*a* while between the leading edge 446 and the dividing rib 480*a*. The first channel 474*a* can continue extending around the base rib end 491*a*, between the dividing rib 480*a* and the center divider 492*a*, and further to between the dividing rib 480*a* and the center rib 493*a*. The first channel 474*a* can then extend toward the root end 444 while located between the dividing rib 480*a* and the center rib 493*a*. The first channel 474*a* can further extend around the center rib base end 494*a* while between the center rib 493*a* and the dividing rib 480*a*, and towards the tip end 445 while between the center rib 493*a* and the dividing rib 480*a*. The first channel 474*a* can continue by extending towards the tip end 445 while between the center rib 493*a* and the dividing rib 480*a*. The first channel 474*a* can further continue by extending around the center rib tip end 495*a* while between the center rib 493*a* and dividing rib 480*a*, towards the base 442 while between the dividing rib 480*a* and the center rib 493*a*. The first channel 474*a* can continue by extending to the center divider 492*a* while between the dividing rib and center rib 493*a*. The first channel 474*a* can continue by extending around the tip rib end 497*a* while between the dividing rib and the center divider 492*a*, to between the dividing rib 480*a* and the leading edge 446. The first channel 474*a* can further continue by extending towards the tip end 445, between the leading edge 446 and the dividing rib 480*a*, to between the dividing rib 480*a* and the tip wall 499, and further to the tip end channel 535.

The second channel 476*a* may extend throughout the turbine blade 440 in a serpentine configuration similar to the first channel 474*a* and can be formed by the dividing rib 480*a*, the skin 460, and other internal structures in the airfoil 441. The second channel 476*a* may be in flow communication with the main inlet 462*a* and the main inlet passage 466*a*. The second channel 476*a* may be in flow communication with the secondary inlet 464*a* and the secondary inlet passage 468*a*. The second channel 476*a* can begin between the dividing rib 480*a* and the base rib 490*a* and disposed adjacent the main inlet 462*a*. Alternatively, the second channel 476*a* can begin between the dividing rib base end 481*a* and the base rib 490*a*. The second channel 476*a* can extend from between the dividing rib 480*a* and the base rib 490*a* to the center divider 492*a*. The second channel 476*a* can continue extending around the base rib end 491*a*, to between the base rib 490*a* and the dividing rib 480*a*, and further towards the base 442. The second channel 476*a* can then extend further towards the root end 444, while located between the base rib 490*a* and the dividing rib 480*a*. The second channel 476*a* can further extend around the center rib base end 494*a* between the dividing rib 480*a* and the root end 444, to between the dividing rib 480*a* and the trailing edge 447. The second channel 476*a* can continue by extending to the tip center rib 498*a* while between the dividing rib 480*a* and the trailing edge 447. The second channel 476*a* can further continue by extending around the center rib tip end 495*a* while between the dividing rib 480*a* and the tip center rib 498*a*, to between the tip rib 496*a* and the dividing rib 480*a*. The second channel 476*a* can continue by extending towards the center divider 492*a* while between the tip rib 496*a* and dividing rib 480*a*. The second channel 476*a* can continue by extending around the tip rib end 497*a* while between the tip rib 496*a* and the dividing rib 480*a*, towards the tip end 445. The second channel 476*a* can further continue by extending towards the tip end 445, between the dividing rib 480*a* and the tip rib 496*a*, to the tip end channel 535.

The internal structures making up the first multi-bend heat exchange path 470*a* and second multi-bend heat exchange path 472*a* may form multiple discrete sub-passageways. For example, although the first multi-bend heat exchange path 470*a* and the second multi-bend heat exchange path 472*a* are shown by a representative path of cooling air 15, multiple composite flow paths are possible.

The possible multiple composite flow paths may include additional features within the airfoil 441. These features may be turbulators 482*a*, cooling fins 486*a*, a first edge air deflector 484*a*, a center air deflector 485*a*, and a tip air deflector 488*a*.

In an embodiment, the turbulators 482*a* may be disposed between the leading edge 446 and the dividing rib 480*a* and between the dividing rib 480*a* and the base rib 490*a*. The turbulators 482*a* can be distributed throughout the other remaining areas of the airfoil 441 as well. The turbulators 482*a* can be formed as ridges on the skin 460 and can be operable to interrupt flow along the first channel 474*a* and second channel 476*a* and prevent formation of a boundary layer which can decrease cooling effects of the cooling air 15.

The cooling fins 486*a* may extend from the pressure side 448 of the skin 460 to the lift side 449 of the skin 460. In an embodiment the cooling fins are disposed between the center rib 493*a* and the trailing edge 447. The cooling fins 486*a* may be disbursed copiously throughout the airfoil 441 or in other selected locations. In particular, the cooling fins 486*a* may be disbursed throughout the airfoil 441 so as to thermally interact with the cooling air 15 for increased cooling. The distribution may be regular, irregular, staggered, and/or localized. According to one embodiment, one or more of the cooling fins 486*a* may be pin fins or pedestals. The pin fins or pedestals may include many different cross-sectional areas, such as: circular, oval, racetrack, square, rectangular, diamond cross-sections, just to mention only a few. As discussed above, the pin fins or pedestals may be arranged as a staggered array, a linear array, or an irregular array.

The airfoil 441 may include several air deflectors including a first edge air deflector 484*a*, a center air deflector 485*a*, and a tip air deflector 488*a* that may extend from the pressure side 448 of the skin 460 to the lift side 449 of the skin. The first edge air deflector 484*a*, center air deflector 485*a*, and tip air deflector 488*a* can also have an aerodynamic shape having a chord length to width ratio of approximately 2:1 to 3:1 ratio. The first edge air deflector 484*a* can be disposed proximate to the center divider 492*a* and the leading edge 446. In other words, the first edge air deflector 484*a* can be disposed proximate to the center divider transition 475*a*. The center air deflector 485*a* can be disposed proximate to the center divider 492*a* and the center rib 493*a*. In other words, the center air deflector 485*a* can be disposed proximate to the center rib transition 477*a*. The tip air deflector 488*a* can be disposed proximate to the leading edge 446 and the tip wall 499. The first edge air deflector 484*a*, center air deflector 485*a*, and tip air deflector 488*a* can have sizes and positions selected to maximize cooling in their respective locations. The first edge air deflector 484*a*, center air deflector 485*a*, and tip air deflector 488*a* may be configured to redirect cooling air 15 flowing through the first channel 474*a*. The size, arrangement, shape of the first edge air deflector 484*a*, center air deflector 485*a*, and tip air deflector 488*a* are selected to optimize cooling effectiveness of the cooling air 15 and increase fatigue life of the cooled turbine blade 440. This can reduce the presence of dead spots, leading to more uniform cooling for the cooled turbine blade 440.

The turbine blade 440 may further include a metering plate 504*a*. The metering plate 504*a* can be disposed adjacent to and radially inward of the main inlet 462*a* with respect to the central axis 95. The metering plate 504*a* may extend from the adjacent the base rib 490*a* towards the forward face 456. The metering plate 504*a* may include a first metering orifice 508*a* and a second metering orifice

509*a*. In an embodiment, the second metering orifice 509*a* is disposed proximate to the dividing rib 480*a* and the base rib 490*a*, and is in flow communication with the second channel 476*a*. The size of the second metering orifice 509*a* can be selected to provide a desired amount or flow of cooling air 15 to the second channel 476*a*. In an embodiment, the first metering orifice 508*a* is disposed between the second metering orifice 509*a* and the forward face 456. The size of the first metering orifice 509*a* can selected to provide a desired amount or flow of cooling air 15 to the first channel 474*a*.

Figure 5:
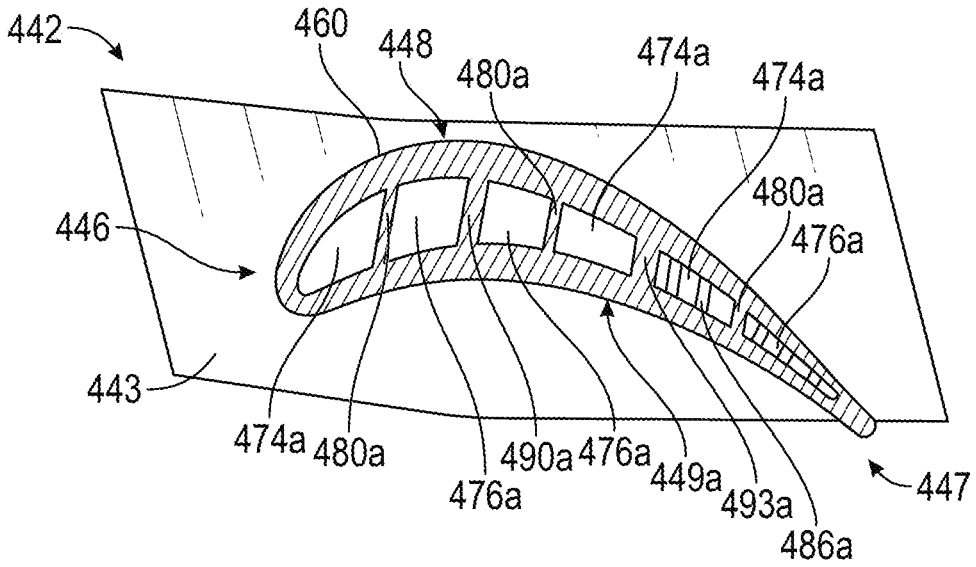
FIG. 5 is a cross section of the cooled turbine blade taken along the line 5-5 of FIG. 4.

FIG. 5 is a cross section of the cooled turbine blade taken along the line 5-5 of FIG. 4. In an embodiment, the airfoil 441 can have a skin 460 that encompasses multiple structural elements. In an embodiment, the first channel 474*a* can be disposed between the leading edge 446 and the dividing rib 480*a*, as well as between the center rib 493*a* and the dividing rib 480*a*. The second channel 476*a* can be disposed between the dividing rib 480*a* and the base rib 490*a*, as well as between the trailing edge 447 and the dividing rib 480*a*.

Figure 6:
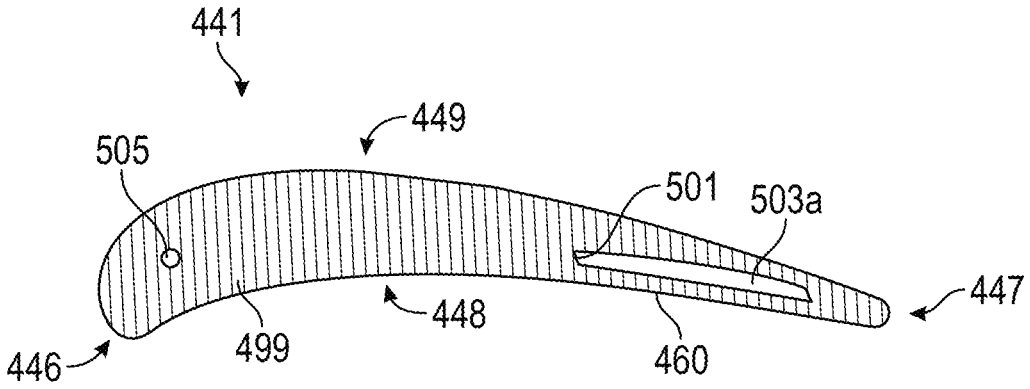
FIG. 6 is a cross section of the cooled turbine blade taken along the line 6-6 of FIG. 4.

FIG. 6 is a cross section of the cooled turbine blade taken along the line 6-6 of FIG. 4. In an embodiment, the airfoil 441 can have a skin 460 that encompasses multiple structural elements. In an embodiment, the tip wall 499 can have a tip end vent 505 that is configured such that a small quantity of the cooling air 15 may be bled off for film cooling near the tip end 445. The airfoil 441 may also include a tip opening 503*a* that is defined by the space between the pressure side 448 of the skin 460, the lift side 449 of the skin, the tip wall 499, and the trailing edge 447. The tip opening 503*a* operable to allow for cooling air 15 to escape the airfoil 441 near the tip end 445.

Figure 7:
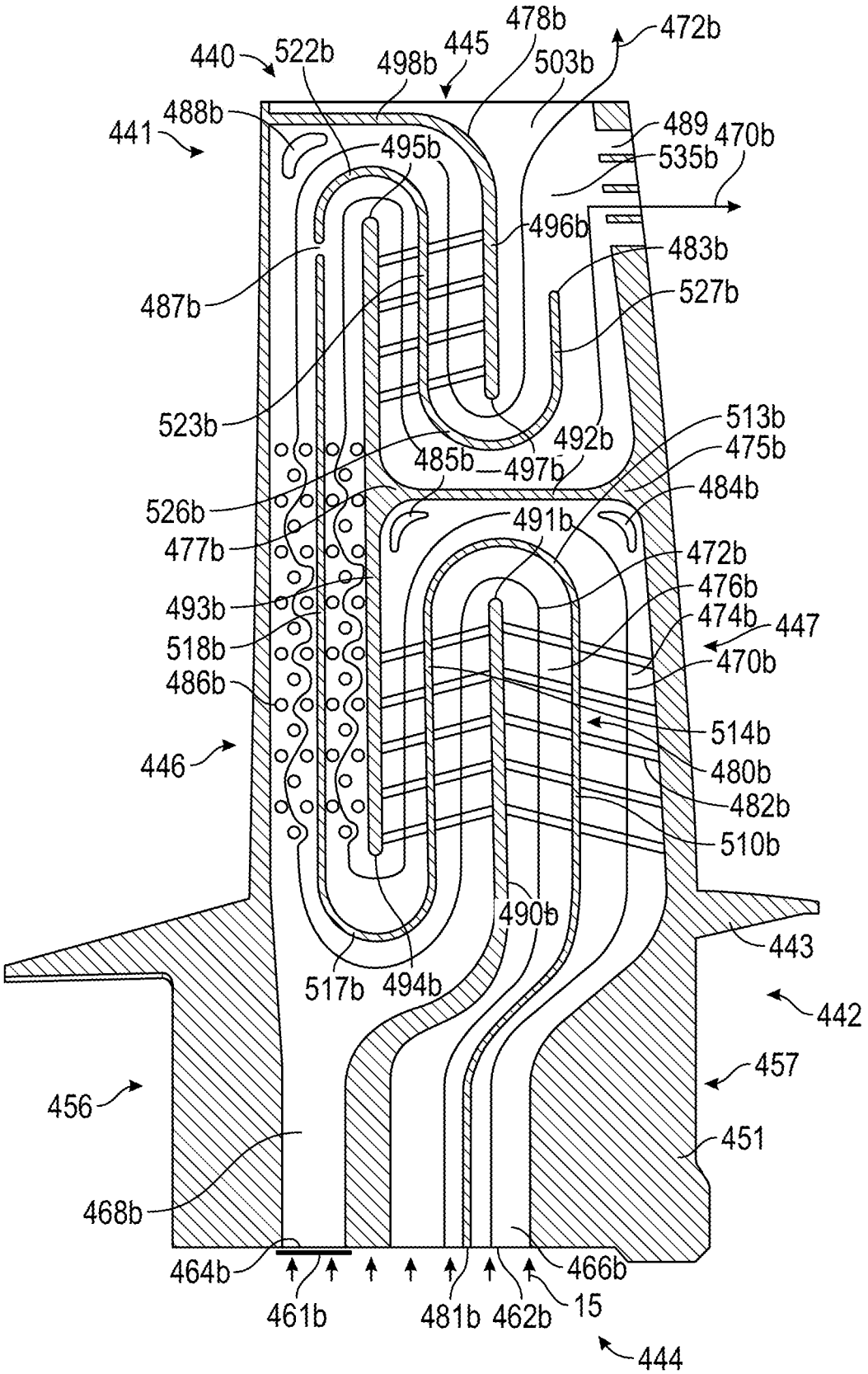
FIG. 7 is a cutaway side view of an another embodiment of the turbine blade of FIG. 3.

FIG. 7 is a cutaway side view of another embodiment of the turbine blade of FIG. 3. Structures and features previously described in connection with earlier described embodiments may not be repeated here with the understanding that when appropriate, that previous description applies to the embodiment depicted in FIG. 7. Additionally, the emphasis in the following description is on variations of previously introduced feature or elements. Also, some reference numbers for previously descripted features are omitted. In particular, another embodiment of the cooled turbine blade 440 of FIG. 3 is shown here with the skin 460 removed from the pressure side 448 of the airfoil 441, exposing its internal structure and cooling paths. The airfoil 441 may include a composite flow path made up of multiple subdivisions and cooling structures. Similarly, a section of the base 442 has been removed to expose portions of a main inlet passage 466*b* and a secondary inlet passage 468*b* internal to the base 442. The turbine blade 440 shown in FIG. 7 generally depicts the features visible from the pressure side 448.

In an embodiment, the base rib 490*b* can bend towards the trailing edge 447 when located proximate to the interface of where the airfoil 441 extends from the base 442. The base rib end 491*b* may be disposed closer to the trailing edge 447 than the base rib 490*b* proximate the root end 444.

In an embodiment, the center divider 492*b* extends from trailing edge 447 towards the leading edge 446. The center divider 492*b* can have a center divider transition 475*b* that extends from the center divider 492*b* to the trailing edge 447 and is wider adjacent the trailing edge 447 than opposite the trailing edge 447. The center divider transition 475*b* may be shaped as a double fillet tee joint joining the center divider 492*b* to the trailing edge 447.

The center rib 493*b* is disposed between the center divider 492*b* and the leading edge 446.

The tip center rib 498*b* extends from the leading edge 446 towards the trailing edge 447 and is disposed between the center rib 493*b* and the tip end 445. The tip center rib 498*b* can include a tip center rib transition 478*b* that extends from the tip center rib 498*b* to the leading edge 446 and be wider adjacent to the leading edge 446 than opposite the leading edge 446. The tip center rib transition 478*b* may be shaped as a fillet joining the tip center rib 498*b* to the leading edge 446.

The tip rib 496*b* extends from the tip center rib 498*b* towards the base 442 and is disposed between the center rib 493*b* and the trailing edge 447.

The tip opening 503*b* is defined by the space between the pressure side 448 of the skin 460, the lift side 449 of the skin, the tip center rib 498*b*, and the trailing edge 447. The tip opening 503*b* allows for cooling air 15 to escape the airfoil 441 through the tip end 445.

The dividing rib 480*b* extends throughout the turbine blade 440 in a serpentine configuration. The dividing rib 480*b* can extend from adjacent the main inlet 462*b* to between the trailing edge 447 and the base rib 490*b*. In an alternative embodiment the dividing rib 480*b* can extend from proximate to the interface of the airfoil 441 and the base 442, to between the trailing edge 447 and the base rib 490*b*, and further to between the leading edge 446 and tip rib 496*b*. In other words the dividing rib can extend from proximate the base 442. The dividing rib 480*b* may have several portions including a dividing rib lower first edge portion 510*b*, a dividing rib lower first edge transition portion 513*b*, a dividing rib lower middle portion 514*b*, a dividing rib lower middle transition portion 517*b*, a dividing rib second edge portion 518*b*, a dividing rib second edge transition portion 522*b*, a dividing rib upper middle portion 523*b*, a dividing rib upper middle transition portion 526*b*, a dividing rib upper first edge portion 527*b*, a dividing rib upper first edge transition portion 530*b*, and a dividing rib tip end portion 531*b*. The dividing rib 480*b* may extend from the pressure side 448 of the skin 460 to the lift side 449 of the skin 460. In an embodiment, the dividing rib 480*b* may have dividing rib gaps 487*b* disposed along the dividing rib 480*b*. Alternatively, the dividing rib 480*b* may remain continuous. The dividing rib 480*b* may also include a dividing rib tip end 483*b* disposed proximate and spaced from the tip end 445.

The dividing rib 480*b* may include a dividing rib base end 481*b* disposed opposite from the dividing rip tip end 485*b*. The dividing rib base end 481*b* can be disposed proximate and spaced from the trailing edge 447, proximate to where the base 442 and airfoil 441 meet. The dividing rib 480*b* can be configured to divide the cooling air 15 into a first channel 474*b* and a second channel 476*b*. The airfoil 441 may include a tip end channel 535 that may begin proximate to the dividing rib tip end 483*b* and where the first channel 474*b* and the second channel 476*b* combine. The tip end channel 535 may be defined by the dividing rib tip end 483*b*, the tip center rib 498*b*, trailing edge 447, the tip rib 496*b*, the pressure side 448 of the skin 460, and the lift side 449 of the skin 460.

In an embodiment, the dividing rib lower first edge portion 510*b* can extend from adjacent the main inlet 462*b* and the root end 444 towards the tip end 445 while between the trailing edge 447 and the base rib 490*b*. In an alternative embodiment, the dividing rib lower first edge portion 510*b* can extend from proximate to the interface of the airfoil 441 and the base 442 towards the tip end 445 while between the trailing edge 447 and the base rib 490*b*. In other words, the dividing rib lower first edge portion 510*b* can extend from proximate the base 442 towards the center divider 492*b*. In other words, the dividing rib lower middle portion 514*b* can extend from proximate to the interface of the airfoil 441 and the base 442 to proximate the base rib end 491*b*.

The dividing rib lower first edge transition portion 513*b* can extend from the dividing rib lower first edge portion 510*b*, from between the trailing edge 447 and the base rib 490*b*, around the base rib end 491*b*, to between the base rib 490*b* and the center divider 492*b*, and further to between the base rib 490*b* and the center rib 493*b*.

The dividing rib lower middle portion 514*b* can extend from the dividing rib lower first edge transition portion 513*b* towards the root end 444 while located between the base rib 490*b* and the center rib 493*b*. In other words, the dividing rib lower middle portion 514*b* can extend from proximate the base rib end 491*b* to proximate the center rib base end 494*b*. The dividing rib lower middle portion is disposed between the center divider 492*b* and the root end 444.

The dividing rib lower middle transition portion 517*b* can extend from the dividing rib lower middle portion 514*b*, from between the base rib 490*b* and the center rib 493*b*, around the center rib 493*b* base end 494*b*, to between the center rib 493*b* and the base rib 490*b*, and further to between the center rib 493*b* and the leading edge 446.

The dividing rib second edge portion 518*b* can extend from the dividing rib lower middle transition portion 517*b* towards the tip end 445 while between the center rib 493*b* and the leading edge 446. In other words, the dividing rib second edge portion 518*b* can extend from proximate the center rib base end 494*b* to proximate the center rib tip end 495*b*. The dividing rib second edge portion 518*b* is disposed between the root end 444 and the tip center rib 498*b*.

The dividing rib second edge transition portion 522*b* can extend from the dividing rib second edge portion 518*b*, from between the leading edge 446 and the center rib 493*b*, around the center rib tip end 495*b*, to between the center rib 493*b* and the tip center rib 498*b*, and further to between the tip rib 496*b* and the center rib 493*b*.

The dividing rib upper middle portion 523*b* can extend from the dividing rib second edge transition portion 522*b* towards the center divider 492*b* while between the tip rib 496*b* and center rib 493*b*. In other words, the dividing rib upper middle portion 523*b* can extend from proximate the center rib tip end 495*b* to proximate the tip rib end 497*b*. The dividing rib upper middle portion 523*b* is disposed between the tip end 445 and the center divider 492*b*.

The dividing rib upper middle transition portion 526*b* can extend from the dividing rib upper middle portion 523*b*, from between the tip rib 496*b* and the center rib 493*b*, around the tip rib end 497*b*, to between the tip rib 496*b* and the center divider 492*b*, and further to between the tip rib 496*b* and the leading edge 446.

The dividing rib upper first edge portion 527*b* can extend from the dividing rib upper middle transition portion 526*b* towards the tip end 445, between the trailing edge 447 and the tip rib 496*b*. In other words, the dividing rib upper first edge portion 527*b* can extend from proximate the tip rib end 497*b* towards the tip end 445. The dividing rib upper first edge portion 527*b* is disposed between the center divider 492*b* and tip end 445.

The first channel 474*b* may extend throughout the turbine blade 440 in a serpentine configuration similar to the dividing rib 480*b* and be formed by the dividing rib 480*b*, the skin 460, and other internal structures in the airfoil 441. The first channel 474*b* can be in flow communication with the main inlet passage 466*b* and main inlet 462*b*. The first channel 474*b* can begin between the forward face 456 and the dividing rib 480*b* and disposed adjacent the main inlet 462*b*. Alternatively, the first channel 474*b* can begin between the dividing rib base end 481*b* and the trailing edge 447. The first channel 474*b* can extend to the center divider 492*b* while between the trailing edge 447 and the dividing rib 480*b*. The first channel 474*b* can continue extending around the base rib end 491*b*, between the dividing rib 480*b* and the center divider 492*b*, to between the dividing rib 480*b* and the center rib 493*b*. The first channel 474*b* can then extend toward the root end 444 while located between the dividing rib 480*b* and the center rib 493*b*. The first channel 474*b* can further extend around the center rib base end 494*b* between the center rib 493*b* and the dividing rib 480*b*, towards the tip end 445 while between the center rib 493*b* and the dividing rib. The first channel 474*b* can continue by extending towards the tip end 445 while between the center rib 493*b* and the dividing rib 480*b*. The first channel 474*b* can further continue by extending around the center rib tip end 495*b* while between the center rib 493*b* and dividing rib 480*b*, towards the base 442 while between the dividing rib 480*b* and the center rib 493*b*. The first channel 474*b* can continue by extending to the center divider 492*b* while between the dividing rib and center rib 493*b*. The first channel 474*b* can continue by extending around the tip rib end 497*b* while between the dividing rib and the center divider 492*b*, to between the dividing rib 480*b* and the trailing edge 447. The first channel 474*b* can further continue by extending towards the tip end 445, between the trailing edge 447 and the dividing rib 480*b*, and further to the tip end channel 535.

The second channel 476*b* may extend throughout the turbine blade 440 in a serpentine configuration similar to the first channel 474*b* and be formed by the dividing rib 480*b*, the skin 460, and other internal structures in the airfoil 441. The second channel 476*b* may be in flow communication with the main inlet 462*b* and the main inlet passage 466*b*. The second channel may be in flow communication with the secondary inlet 464*b* and the secondary inlet passage 468*b*. The second channel 476*b* can begin between the dividing rib 480*b* and the base rib 490*b* and disposed adjacent the main inlet 462*b*. Alternatively, the second channel 476*b* can begin between the dividing rib base end 481*b* and the base rib 490*b*. The second channel 476*b* can extend from between the dividing rib 480*b* and the base rib 490*b* to the center divider 492*b*. The second channel 476*b* can continue extending around the base rib end 491*b*, between the base rib 490*b* and the dividing rib 480*b*, towards the base 442. The second channel 476*b* can then extend further towards the root end 444, while located between the base rib and the dividing rib 480*b*. The second channel 476*b* can further extend around the center rib base end 494*b* between the dividing rib 480*b* and the root end 444, to between the dividing rib 480*b* and the leading edge 446. The second channel 476*b* can continue by extending to the tip center rib 498*b* while between the dividing rib 480*b* and the leading edge 446. The second channel 476*b* can further continue by extending around the center rib tip end 495*b* while between the dividing rib 480*b* and the tip center rib 498*b*, to between the tip rib 496*b* and the dividing rib 480*b*. The second channel 476*b* can continue by extending towards the center divider 492*b* while between the tip rib 496*b* and dividing rib 480*b*. The second channel 476*b* can continue by extending around the tip rib end 497*b* while between the tip rib 496*b* and the dividing rib 480*b*, towards the tip end 445. The second channel 476*b* can further continue by extending towards the tip end 445 and to the tip end channel 535.

In an embodiment, the turbulators 482*b* may be disposed between the trailing edge 447 and the dividing rib 480*b* and between the dividing rib 480*b* and the base rib 490*b*. The turbulators 482*b* can be distributed throughout the other remaining areas of the airfoil 441 as well.

The cooling fins 486*b* may extend from the pressure side 448 of the skin 460 to the lift side 449 of the skin 460. In an embodiment the cooling fins 486*b* are disposed between the center rib 493*b* and the leading edge 446. The cooling fins 486*b* may be disbursed copiously throughout the airfoil 441. In particular, the cooling fins 486*b* may be disbursed throughout the airfoil 441 so as to thermally interact with the cooling air 15 for increased cooling.

The airfoil 441 may include several air deflectors including a first edge air deflector 484*b*, a center air deflector 485*b*, and a tip air deflector 488*b* that may extend from the pressure side 448 of the skin 460 to the lift side 449 of the skin. The first edge air deflector 484*b* can be disposed proximate to the center divider 492*b* and the trailing edge 447. The tip air deflector 488*b* can be disposed proximate to the leading edge 446 and the tip center rib 498*b*. The first edge air deflector 484*b*, center air deflector 485*b*, and tip air deflector 488*b* can have sizes and positions selected to maximize cooling in their respective locations.

INDUSTRIAL APPLICABILITY

The present disclosure generally applies to cooled turbine blades 440, and gas turbine engines 100 having cooled turbine blades 440. The described embodiments are not limited to use in conjunction with a particular type of gas turbine engine 100, but rather may be applied to stationary or motive gas turbine engines, or any variant thereof. Gas turbine engines, and thus their components, may be suited for any number of industrial applications, such as, but not limited to, various aspects of the oil and natural gas industry (including include transmission, gathering, storage, withdrawal, and lifting of oil and natural gas), power generation industry, cogeneration, aerospace and transportation industry, to name a few examples.

Generally, embodiments of the presently disclosed cooled turbine blades 440 are applicable to the use, assembly, manufacture, operation, maintenance, repair, and improvement of gas turbine engines 100, and may be used in order to improve performance and efficiency, decrease maintenance and repair, and/or lower costs. In addition, embodiments of the presently disclosed cooled turbine blades 440 may be applicable at any stage of the gas turbine engine's 100 life, from design to prototyping and first manufacture, and onward to end of life. Accordingly, the cooled turbine blades 440 may be used in a first product, as a retrofit or enhancement to existing gas turbine engine, as a preventative measure, or even in response to an event. This is particularly true as the presently disclosed cooled turbine blades 440 may conveniently include identical interfaces to be interchangeable with an earlier type of cooled turbine blades 440.

As discussed above, the entire cooled turbine blade 440 may be cast formed. According to one embodiment, the cooled turbine blade 440 may be made from an investment casting process. For example, the entire cooled turbine blade 440 may be cast from stainless steel and/or a superalloy using a ceramic core or fugitive pattern. Accordingly, the inclusion of the dividing rib 480*a*, 480*b* is amenable to the manufacturing process. Notably, while the structures/features have been described above as discrete members for clarity, as a single casting, the structures/features may be integrated with the skin 460. Alternately, certain structures/features may be added to a cast core, forming a composite structure.

Embodiments of the presently disclosed cooled turbine blades 440 provide for an increase in cooling capacity, which makes it more amenable to stationary gas turbine engine applications. In particular, serpentine configuration provides for improved cooling at lower spans of the airfoil and use the spent cooling air 15 from the lower span to continue and cool the upper span of the airfoil where the turbine blade 440 can tolerate higher metal temperatures.

In a disclosed embodiment, pressurized cooling air 15 is received by the base 442 of the airfoil 441. The cooling air 15 is received from the main inlet 462*a*, 462*b* and flows through the main inlet passage 466*a*, 466*b* in a generally radial direction. From the main inlet passage 466*a*, 466*b*, the cooling air 15 is received by the first channel 474*a*, 474*b* and the second channel 476*a*, 476*b* and may follow the first multi-bend heat exchange path 470*a*, 470*b* and the second multi-bend heat exchange path 472*a*, 472*b* respectively. A first turn of the first channel 474*a*, 474*b* and the second channel 476*a*, 476*b* around the base rib 490*a*, 492*b* provides increased cooling effects of the cooling air 15 as it passes through the lower span of the turbine blade 440.

The cooling air 15 generally follows the first channel 474*a*, 474*b* and the second channel 476*a*, 476*b* along the dividing rib 480*a*, 480*b* until the first channel 474*a*, 474*b* and second channel 476*a*, 476*b* approach the tip end 445 and combine into the tip end channel 535*a*, 535*b*. Once the cooling air 15 enters the tip end channel 535*a*, 535*b* the cooling air 15 is generally directed out of the trailing edge outlet 489*a*, 489*b* or the tip opening 503*a*, 503*b*.

The first multi-bend heat exchange path 470*a*, 470*b* and the second multi-bend heat exchange path 472*a*, 472*b* are configured such that cooling air 15 will pass between, along, and around the various internal structures, but generally flows in serpentine path as viewed from the side view from the base 442 back and forth toward and away from the tip end 445 (e.g., conceptually treating the camber sheet as a plane). Accordingly, the first multi-bend heat exchange path 470*a*, 470*b* and the second multi-bend heat exchange path 472*a*, 472*b* may include some negligible lateral travel (e.g., into and out of the plane) associated with the general curvature of the airfoil 441. Also, as discussed above, although the first multi-bend heat exchange path 470*a*, 470*b* and the second multi-bend heat exchange path 472*a*, 472*b* are illustrated by two single representative flow lines traveling through two sections for clarity, first multi-bend heat exchange path 470*a*, 470*b* and the second multi-bend heat exchange path 472*a*, 472*b* include the entire flow path carrying cooling air 15 through the airfoil 441. With the implementation of the dividing rib 480*a*, 480*b*, the first multi-bend heat exchange path 470*a*, 470*b* and the second multi-bend heat exchange path 472*a*, 472*b* make use of the serpentine flow path with more uniform temperature distribution in comparison to single bend turbine blades. This provides for a higher cooling efficiency at lower spans and helps break up possible dead zones.

In rugged environments, certain superalloys may be selected for their resistance to particular corrosive attack. However, depending on the thermal properties of the superalloy, greater cooling may be beneficial. The described method of manufacturing a cooled turbine blade 440 provides for implementing the dividing rib 480*a*, 480*b*. In particular, the dividing rib 480*a*, 480*b* creates two channels which achieve a more uniform temperature distribution of a turbine blade and increase cooling efficiency at lower airfoil spans and could increase blade life. Moreover, the internal airfoil structures including the dividing rib 480*a*, 480*b* can be suitable for use in turbine blades with thin blade airfoils.

Although this invention has been shown and described with respect to detailed embodiments thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. The embodiments are not limited to those that solve any or all of the stated problems or those that have any or all of the stated benefits and advantages.

What is claimed is:

1. A turbine blade for use in a gas turbine engine, the turbine blade comprising:

a base including a root end; and an airfoil comprising a skin extending from the base and defining a first edge, a second edge opposite the first edge, a pressure side, and a lift side opposite the pressure side, and having a tip end opposite from the root end, a base rib disposed within the airfoil and the base, extending from the base and into the airfoil, and having a base rib end disposed opposite from the base, a center divider extending from adjacent the first edge towards the second edge, disposed between the base rib and the tip end, a center rib disposed between the center divider and the second edge, extending from adjacent the center divider towards the tip end and extending from adjacent the center divider towards the root end, the center rib disposed between the root end and the tip end and at least partially between the base rib and the second edge, and having a center rib tip end disposed at the tip end of the center rib, and a center rib base end disposed opposite from the tip end, a tip center rib extending from adjacent the second edge towards the first edge, disposed between the center rib and the tip end, a tip rib extending from adjacent the tip center rib, distal to the second edge, towards the base, the tip rib disposed at least partially between the center rib and the first edge, disposed between the center divider and the tip end, and having a tip rib end disposed opposite from the tip end, and a dividing rib extending from proximate an interface of the airfoil and the base, towards the tip end while between the first edge and the base rib, to between the tip rib and the first edge and between the tip end and the center divider, and having a dividing rib tip end disposed proximate and spaced from the tip end; and a first channel beginning proximate the interface of the airfoil and the base, the first channel extending to the center divider while between the first edge and the dividing rib, the first channel further extends around the base rib tip, between the dividing rib and the center divider, and further to between the dividing rib and the center rib, the first channel further extends toward the root end while located between the dividing rib and the center rib, the first channel further extends around the center rib base end while between the center rib and the dividing rib, towards the tip end while between the center rib and the dividing rib, the first channel further extends towards the tip end while between the center rib and the dividing rib, the first channel further extends around the center rib tip end while between the center rib and dividing rib, towards the base while between the dividing rib and the center rib, the first channel further extends to the center divider while between the dividing rib and center rib, the first channel further extends around the tip rib end while between the dividing rib and the center divider, to between the dividing rib and the first edge, the first channel further extends towards the tip end, between the first edge and the dividing rib.

2. The turbine blade of claim 1, the turbine blade further comprising a second channel beginning proximate the interface of the airfoil and the base, the second channel extending from between the dividing rib and the base rib to the center divider, the second channel further extends around the base rib end, to between the base rib and the dividing rib, and further towards the base, the second channel further extends towards the root end while located between the base rib and the dividing rib, the second channel further extends around the center rib base end between the dividing rib and the root end, to between the dividing rib and the second edge, the second channel further extends to the tip center rib while between the dividing rib and the second edge, the second channel further extends around the center rib tip end while between the dividing rib and the tip center rib, to between the tip rib and the dividing rib, the second channel further extends towards the center divider while between the tip rib and dividing rib, the second channel further extends around the tip rib end while between the tip rib and the dividing rib, towards the tip end, the second channel further extends towards the tip end, between the dividing rib and the tip rib.

3. The turbine blade of claim 1, wherein the center rib and the dividing rib extend into the base.

4. The turbine blade of claim 1, the dividing rib further comprising a dividing rib lower first edge portion extending from proximate to an interface of the airfoil and the base, towards the center divider while between the first edge and the base rib, a dividing rib lower first edge transition portion extending from between the first edge and base rib, to between the base rib and the center divider, and further to between the base rib and the center rib, a dividing rib lower middle portion extending from between the base rib and center rib towards the root end while located between the base rib and the center rib, a dividing rib lower middle transition portion extending from between the base rib and the center rib, to between the center rib and the root end, and further to between the center rib and the second edge, a dividing rib second edge portion extending from between the center rib and the second edge towards the tip center rib, a dividing rib second edge transition portion extending from between the second edge and the center rib, to between the center rib and the tip center rib, and further to between the tip rib and the center rib, a dividing rib upper middle portion extending from between the tip rib and center rib towards the center divider, a dividing rib upper middle transition portion extending from between the tip rib and center rib, to between the tip rib and the center divider, and further to between the tip rib and the first edge, and a dividing rib upper first edge portion extending from between the first edge and the tip rib towards the tip end.

5. The turbine blade of claim 1, wherein the base rib bends towards the first edge when located proximate to the interface of the airfoil and the base.

6. A turbine blade for use in a gas turbine engine, the turbine blade comprising:

a base including a root end; and an airfoil comprising a skin extending from the base and defining a leading edge, a trailing edge opposite from the leading edge, a pressure side, and a lift side opposite the lift side, and having a tip end opposite from the root end, a base rib disposed between leading edge and the trailing edge, extending from the base and towards the tip end, a center divider extending from adjacent the leading edge towards the trailing edge, disposed between the base rib and the tip end, a center rib disposed between the center divider and the trailing edge, extending from adjacent the center divider towards the tip end and extending from adjacent the center divider towards the root end, the center rib disposed between the root end and the tip end and at least partially between the base rib and the trailing edge, a tip center rib extending from adjacent the trailing edge towards the leading edge, disposed between the center rib and the tip end, a tip rib extending from adjacent the tip center rib towards the base, distal to the trailing edge, the tip rib disposed at least partially between the center rib and the leading edge, and disposed between the center divider and the tip end, a tip wall extending from the leading edge towards the trailing edge, disposed proximate the tip end; and a dividing rib including a dividing rib lower first edge portion extending from proximate the interface of the airfoil and the base, towards the tip end while between the leading edge and the base rib, a dividing rib lower first edge transition portion extending from between the leading edge and the base rib, to between the base rib and the center divider, and further to between the base rib and the center rib, a dividing rib lower middle portion extending from between the base rib and center rib towards the root end while located between the base rib and the center rib, a dividing rib lower middle transition portion extending from between the base rib and the center rib, to between the center rib and the root end, and further to between the center rib and the trailing edge, a dividing rib second edge portion extending from between the center rib and the trailing edge towards the tip center rib, a dividing rib second edge transition portion extending from between the trailing edge and the center rib, to between the center rib and the tip center rib, and further to between the tip rib and the center rib, a dividing rib upper middle portion extending from between the tip rib and center rib towards the center divider, a dividing rib upper middle transition portion extending from between the tip rib and center rib, to between the tip rib and the center divider, and further to between the tip rib and the leading edge, and a dividing rib upper first edge portion extending from between the leading edge and the tip rib towards the tip wall, to between the center divider and tip wall.

7. The turbine blade of claim 6, wherein the dividing rib lower first edge transition extends from the dividing rib lower first edge portion, the dividing rib lower middle portion extends from the dividing rib lower first edge transition portion, the dividing rib lower middle transition portion extends from the dividing rib lower middle portion, the dividing rib second edge portion extends from the dividing rib lower middle transition portion, the dividing rib second edge transition portion extends from the dividing rib second edge portion, the dividing rib upper middle portion extends from the dividing rib second edge transition portion, the dividing rib upper middle transition portion extends from the dividing rib upper portion, the dividing rib upper first edge portion extends from the dividing rib upper middle transition portion.

8. The turbine blade of claim 7, the turbine blade further comprising a first channel formed by the dividing rib, the skin, the leading edge, the center divider, and the center rib, and a second channel formed by the dividing rib, the skin, the base rib, the trailing edge, the tip center rib, and the tip rib.

9. The turbine blade of claim 6, the center divider further comprising a center divider transition extending from the center divider to the leading edge towards the trailing edge, that is wider adjacent the leading edge than opposite from the leading edge, and a center rib transition disposed opposite from the center divider transition, extending from the center divider to the center rib towards the leading edge, that is wider adjacent the center rib than opposite the center rib.

10. The turbine blade of claim 6, the tip center rib further comprising a tip center rib transition extending from the tip center rib to the trailing edge towards the leading edge, that is wider adjacent the trailing edge than opposite the trailing edge, and a tip rib transition that is disposed opposite from the tip center rib transition that extends from the tip center rib towards the base.

11. The turbine blade of claim 8, the turbine blade further comprising a main inlet disposed in the base and in flow communication with the first channel and the second channel, and a secondary inlet disposed in the base and in flow communication with the second channel.

12. The turbine blade of claim 11, the turbine blade further comprising a metering plate blocking plate disposed radially inward of the main inlet, the metering plate having a first metering orifice sized to provide a desired amount or flow of cooling air to the first channel, and a second metering orifice sized to provide a desired amount or flow of cooling air to the second channel.

13. The turbine blade of claim 11, wherein the dividing rib lower first edge portion extends from main inlet to between the base rib and the leading edge.

14. A turbine blade for use in a gas turbine engine, the turbine blade comprising:

a base including a root end; and an airfoil comprising a skin extending from the base and defining a leading edge, a trailing edge opposite the leading edge, a pressure side, and a lift side opposite the pressure side, and having a tip end opposite from the root end, a base rib disposed between leading edge and the trailing edge, extending from the base and towards the tip end, having a base rib end disposed opposite from the base, a center divider extending from adjacent the trailing edge towards the leading edge, disposed between the base rib and the tip end, a center rib disposed between the center divider and the leading edge, extending from adjacent the center divider towards the tip end and extending from proximate the center divider towards the root end and at least partially between the base rib and the leading edge, and having a center rib tip end disposed at the tip end of the center rib, and a center rib base end disposed opposite from the tip end, a tip center rib extending from adjacent the leading edge towards the trailing edge, disposed between the center rib and the tip end, a tip rib extending from adjacent the tip center rib, distal to the leading edge, towards the base, the tip rib disposed at least partially between the center rib and the trailing edge, further disposed between the center divider and the tip end, and having a tip rib end disposed opposite from the tip end, a dividing rib extending from proximate to an interface of the airfoil and the base, towards the tip end while between the trailing edge and the base rib, to between the tip rib and the trailing edge and between the tip end and the center divider, and having a dividing rib tip end disposed proximate and spaced from the tip end, a second channel beginning proximate the interface of the airfoil and the base, the second channel extending from between the dividing rib and the base rib to the center divider, the second channel further extends around the base rib tip, to between the base rib and the dividing rib, and further towards the base, the second channel then further extends towards the root end while located between the base rib and the dividing rib, the second channel further extends around the center rib base end between the dividing rib and the root end, to between the dividing rib and the leading edge, the second channel further extends to the tip center rib while between the dividing rib and the leading edge, the second channel further extends around the center rib tip end while between the dividing rib and the tip center rib, to between the tip rib and the dividing rib, the second channel further extends towards the center divider while between the tip rib and dividing rib, the second channel further extends around the tip rib end while between the tip rib and the dividing rib, towards the tip end, the second channel further extends towards the tip end, between the dividing rib and the tip rib.

15. The turbine blade of claim 14, the turbine blade further comprising a first channel beginning proximate the interface of the airfoil and the base, the first channel extending to the center divider while between the trailing edge and the dividing rib, the first channel further extends around the base rib tip, between the dividing rib and the center divider, and further to between the dividing rib and the center rib, the first channel further extends toward the root end while located between the dividing rib and the center rib, the first channel further extends around the center rib base end while between the center rib and the dividing rib, towards the tip end while between the center rib and the dividing rib, the first channel further extends towards the tip end while between the center rib and the dividing rib, the first channel further extends around the center rib tip end while between the center rib and dividing rib, towards the base while between the dividing rib and the center rib, the first channel further extends to the center divider while between the dividing rib and center rib, the first channel further extends around the tip rib end while between the dividing rib and the center divider, to between the dividing rib and the trailing edge, the first channel further extends towards the tip end, between the trailing edge and the dividing rib, to between the dividing rib and the tip wall.

16. The turbine blade of claim 14, the dividing rib further comprising a dividing rib lower first edge portion extending from proximate to an interface of the airfoil and the base towards the tip end, disposed between the trailing edge and the base rib, a dividing rib lower first edge transition portion extending from the dividing rib lower first edge portion, to between the base rib and the center divider, and further to between the base rib and the center rib, a dividing rib lower middle portion extending from the dividing rib lower first edge transition portion towards the root end while located between the base rib and the center rib, the dividing rib lower middle portion disposed between the center divider and the root end, a dividing rib lower middle transition portion extending from the dividing rib lower middle portion, to between the center rib and the root end, and further to between the center rib and the leading edge, a dividing rib second edge portion extending from the dividing rib lower middle transition portion towards the tip end while between the center rib and the leading edge, the dividing rib second edge portion disposed between the root end and the tip center rib, a dividing rib second edge transition portion extending from the dividing rib second edge portion, to between the center rib and the tip center rib, and further to between the tip rib and the center rib, a dividing rib upper middle portion extending from the dividing rib second edge transition portion towards the center divider while between the tip rib and center rib, the dividing rib upper middle portion disposed between the tip center rib and the center divider, a dividing rib upper middle transition portion extending from the dividing rib upper middle portion, to between the tip rib and the center divider, and further to between the tip rib and the trailing edge, and a dividing rib upper first edge portion extending from the dividing rib upper middle transition portion towards the tip end, between the trailing edge and the tip rib.

17. The turbine blade of claim 15, the turbine blade further comprising a main inlet disposed in the base and in flow communication with the first channel and the second channel, and a secondary inlet disposed in the base and in flow communication with the second channel.

18. The turbine blade of claim 17, the turbine blade further comprising a blocking plate disposed radially inward of the secondary inlet that can restrict cooling air from entering the secondary inlet.

19. The turbine blade of claim 14, wherein the turbine blade includes a tip opening that is defined by the space between the pressure side of the skin, the lift side of the skin, the tip center rib, and the trailing edge. The tip opening operable to allow for cooling air to escape the airfoil near the tip end.

20. The turbine blade of claim 16, wherein the dividing rib lower first edge portion extends from adjacent the root end to between the base rib and the trailing edge.

* * * * *